US005385271A

United States Patent [19]

Bierend et al.

[11] Patent Number: 5,385,271

[45] Date of Patent: Jan. 31, 1995

[54] UTILITY-POWER OPERATED AEROSOL SPRAY CAN

[76] Inventors: Steven J. Bierend, 530 Parkview North, Santa Maria, Calif. 93455; Clyde L. Tichenor, 905 N. Oak Ave., Fillmore, Calif. 93015; Irwin Ginsburgh, 24125 Clearbank La., Newhall, Calif. 91321

[21] Appl. No.: 95,851

[22] Filed: Jul. 23, 1993

[51] Int. Cl.[6] ..... B67B 5/00

[52] U.S. Cl. ..... 222/153; 222/402.11; 222/504

[58] Field of Search ..... 222/153, 402.11, 504; 239/340, 359; 137/614.19

[56] References Cited

U.S. PATENT DOCUMENTS

| | | | |
|---|---|---|---|
| 3,666,144 | 5/1972 | Winder | 222/504 X |
| 4,483,466 | 11/1984 | Gutierrez | 222/504 X |
| 5,294,022 | 3/1994 | Earle | 222/504 X |

*Primary Examiner*—Andres Kashnikow
*Assistant Examiner*—Joseph A. Kaufman
*Attorney, Agent, or Firm*—Albert O. Cota

[57] ABSTRACT

An aerosol spray can (12) that can only be operated when connected to an a-c utility power source provided by a power cord (22) that includes a power-line activator (30). Thus, the use of an aerosol spray can (12) to spray graffiti is prevented or at least minimized. The can (12) is modified by attaching to its upper section (14) a valve attachment port (16) to which is attached a lower fluid port (86) located on a slide and twist valve (80). The valve (80) also includes an upper fluid port (84) having a check valve (88) that opens when a standard spray head (26) is depressed and a permanent magnet piston (90) having a fluid passage bore (96). When no power is applied, a compression spring (94) positions the piston (90) with the bore (96) misaligned in both a radial and longitudinal position that prevents the passage of the fluid. Conversely, when power is applied, an electromagnet (36) in the power-line activator (30) aligns the fluid passage bore (96) with the upper and lower fluid ports (84,86) to allow fluid to pass when the spray head (26) is depressed.

20 Claims, 3 Drawing Sheets

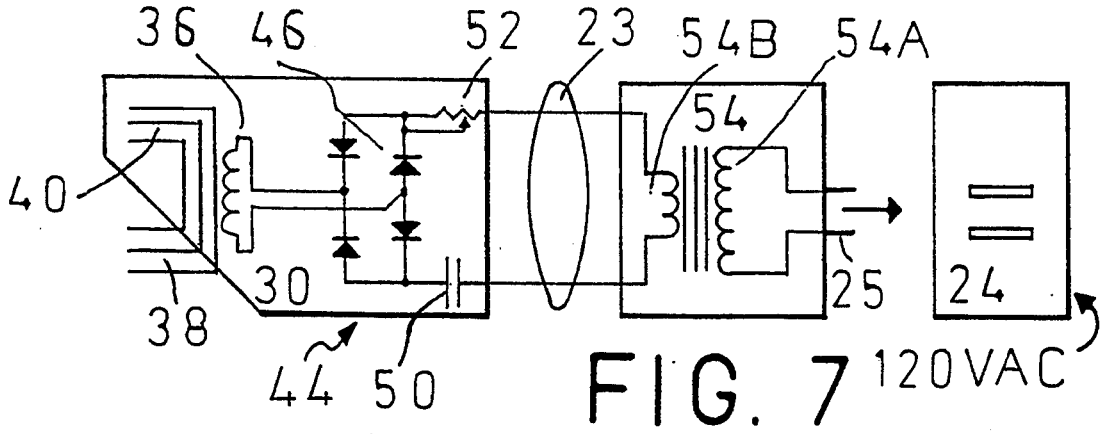
FIG. 7
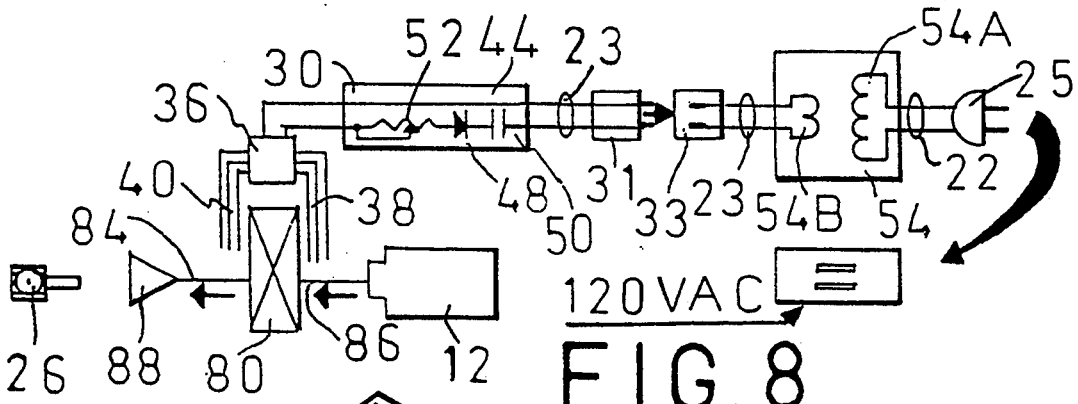
FIG. 8
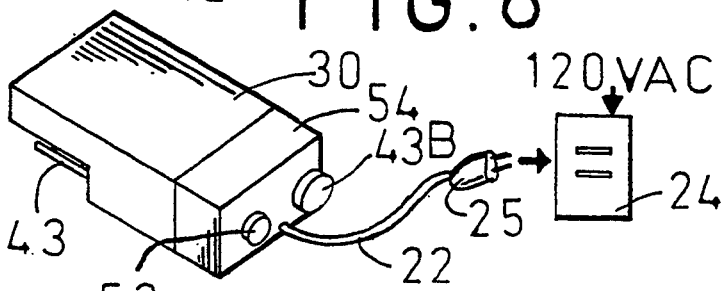
FIG. 9
FIG. 10
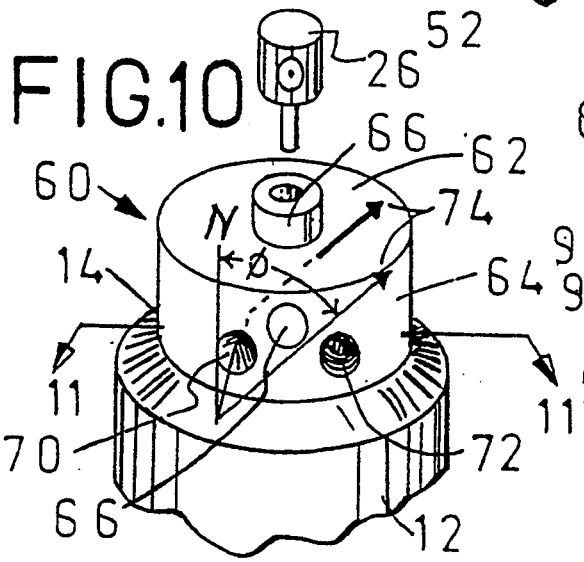
FIG. 11
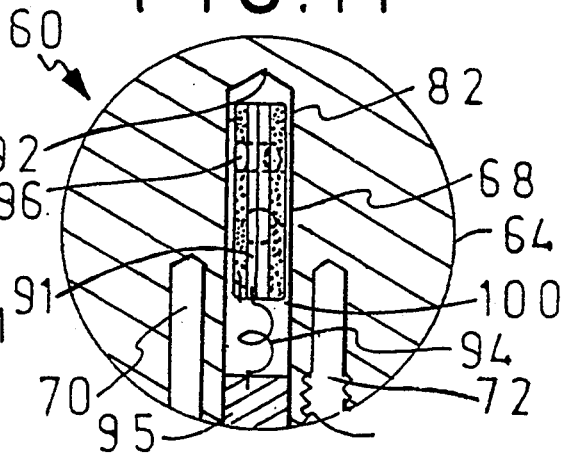

UTILITY-POWER OPERATED AEROSOL SPRAY CAN

TECHNICAL FIELD

The invention pertains to the general field of aerosol spray cans and more particularly to an aerosol paint spray can that can only be operated when it is connected by means of an a–c power cord, to an a–c utility power source.

BACKGROUND ART

The use of graffiti to deface various types of surfaces is wide spread both in cities of the United States of America and cities of many other industrialized world nations. Graffiti can consist of any unauthorized name, word or symbol or any combination thereof that is placed on a public or private surfaces by so called "graffiti taggers". Graffiti taggers have been around and have marked public surfaces since the days of the Pharaohs—even the pyramids did not escape this aesthetic plaque. Today, there is hardly a blank wall in inner cities, such as in central Los Angeles, that does not display some form of graffiti.

The primary target areas for graffiti taggers include public and private businesses, street and freeway signs, subways, trains and buses. To curtail the application of graffiti, several plans, devices and activities have been implemented: in Los Angeles, for instance, 4,000 people participated in a graffiti paint-out spearheaded by the Los Angeles Police Department. In one morning, the volunteers used 1700 gallons of paint and eradicated 62,000 feet of graffiti. The work of both public and private graffiti cleanup efforts are evident across the city in patchwork squares of unmatched paint on walls and buildings. As well meaning as cleanup techniques are, statistics have shown that when graffiti is covered in patches, the patches are invitations to graffiti vandals. Thus, graffiti is three times as likely to reappear then if the wall were all one color. To prevent street and particularly high-rise freeway signs from being marked razor wire has been placed around the signs access areas. The Transit Authorities of the various cities have taken cars out of service for cleaning as soon as they were marred by graffiti, no matter how slight the marking. Guards and dogs have also been posted in yards where these vehicles are stored for cleaning and maintenance.

To implement the graffiti removal and watch programs has been costly for city governments. Most of the money goes to pay for crews that respond to the complaints by homeowners and businesses. Last year, the Los Angeles county government spent over $10 million trying to clean up the graffiti. The city of Los Angeles spent another $4 million, and the Southern California Rapid Transmit district spent $5 million. These figures are in addition to the money spend by various police agencies in chasing and arresting graffiti taggers. In New York, the Transit Authority has spent $6 billion in subway cleanup campaigns. Workers spend an average of 110 hours a week cleaning spray-paint off subway cars. In subways, it has been estimated that the national cost for controlling graffiti will exceed $4 billion. In addition to the cost involved in trying to eradicate graffiti, there is also the cost involved in decreased property values and in the more intangible psychic costs of living in a city that looks as though it is under siege.

Graffiti taggers use ballpoint pens, felt-tip markers and aerosol spray cans to perform their work with spray cans being the marker of choice. Over the years there have been various efforts to control graffiti by clamping down on the use of aerosol paint spray cans. According to the paint industry about 41,400 of these paint spray cans with a retail value of $120,000 are sold each day in Los Angeles, Orange, Riverside and San Bernardino Counties. By another estimate, more than 8,000 of these spray cans are used daily to deface property nationwide. To curtail the adverse use of spray cans, laws have been passed or are in process of passage to keep spray cans locked up, making these cans unavailable for purchase by persons under the age of 18 and even to ban the sale of spray paint cans statewide, except those used by commercial firms. An outright ban is, of course, unfair to both the manufacturers and retailers—and most likely ineffective.

A search of the prior art did not disclose any patents or other literature that read directly on the claims of the instant invention. Particularly, no patents were found that disclosed aerosol paint spray cans that can only be operated when connected to a utility power source. However, the following U.S. patents were considered related:

| U.S. PAT. NO. | INVENTOR | ISSUED |
|---|---|---|
| 5,014,884 | Wonsch | 14 May 1991 |
| 4,972,975 | Fuhrig | 27 November 1990 |
| 4,971,257 | Birge | 20 November 1990 |

The U.S. Pat. No. 5,014,884 Wonsch patent discloses an aerosol spray can that includes a spray mechanism for finely atomizing fluids through a hydraulically-operated pump. The spray mechanism is inserted into a housing which is connected with the supply container for the liquid through a close-fitted or frictional locking connection. The spray mechanism incorporates a battery operated gear pump in which, the suction line of the pump is connected through an opening in the bottom of the housing into the supply container. The supply container is equipped with a venting line, whereby the gear pump includes a pressure tube at its output which is connected with a discharge nozzle.

The U.S. Pat. No. 4,972,975 Fuhrig patent discloses a housing that stores a battery that powers an electric motor that operates a compressor for producing compressed air in combination with a suction unit and a pressure joint. A product container that includes a spray nozzle is placed inside the housing with a connection between the pressure joint of the compressor and the interior of the product container. The compressor pressurizes the product container through an aperture thereby forcing the liquid through the container spray nozzle.

The U.S. Pat. No. 4,971,257 Birge patent discloses an electrostatic particle spraying apparatus. The apparatus includes a hand held triggering mechanism that includes a d-c power source and a coupling sleeve into which a conventional aerosol spray can is inserted when the triggering mechanism is squeezed, a hammer depresses the nozzle tip of the aerosol can, releasing the pressurized fluid of the can from the nozzle tip.

For background purposes and indicative of the art to which the invention relates, reference may be made to the following remaining patents found in the pre-examination search:

| U.S. PAT. NO. | INVENTOR | ISSUED |
|---|---|---|
| 5,069,391 | Seasholtz | 3 December 1991 |
| 4,618,099 | Nagad et al | 21 October 1986 |

DISCLOSURE OF THE INVENTION

The aerosol spray can disclosed herein is designed to operate only if the can is connected to a utility a–c power source. The primary purpose of the invention is to prevent graffiti taggers from using an aerosol spray can to spray graffiti because they do not have ready access to an a–c power source. In its most basic design, the inventive aerosol spray can consists of:

a) an aerosol spray can that is filled with a fluid such as a paint. The can is modified by attaching a valve attachment port to its upper section, b) a standard aerosol-can spray head, c) an a–c power cord, and d) a valve means having an upper fluid port within which is attached the spray head and a lower fluid port that is attached by an attachment means to the valve attachment port on the spray can. The valve is operated by the a–c utility power supplied through a power cord. When power is not applied, the valve is positioned to prevent the fluid in the can from being sprayed. conversely, when power is applied, the valve is repositioned to allow the fluid in the can to be sprayed when the spray head is depressed.

In a preferred embodiment, the valve means consists of a magnetically activated slide and twist valve that is operated by an a–c voltage supplied through a power-line activator.

The activator includes an electromagnet that is operated by an electronic circuit consisting of a full-wave rectifier that is supplied the a–c utility power by a low-voltage a–c to a–c power supply through a blocking capacitor and voltage-level setting potentiometer. The electromagnet has a first magnetic pole rod that corresponds to magnetic south and a second magnetic pole piece corresponding to magnetic north. The two poles are displaced from each other by a fixed distance and are rotated from vertical alignment by an electro-magnetic field angle $\phi$.

The slide and twist valve includes a central cavity that interfaces with an upper fluid port and a lower fluid port. The upper port houses a spray control valve that interfaces with a standard aerosol-can spray head and the lower fluid port is connected to the valve attachment port located on the aerosol can. The center cavity interfaces with the upper and lower fluid ports and functions as a cylinder for a permanent magnet piston that has a fluid passage bore therethrough normal to its longitudinal axis.

When power is not applied by the power-line activator the fluid passage bore of the piston is displaced from the upper and lower fluid ports both radially and longitudinally by a compression spring attached to the piston and an access plug. In this displaced position, the fluid in the can is prevented from passing through the upper fluid port. When the aerosol can is to be used, the power-line activator is connected by means of a power cord to an a–c utility power receptacle so that power is directed to the electromagnet. When the electromagnet is energized, the spring bias of the spring is overcome and the piston is aligned correctly both radially and longitudinally by the first magnetic pole rod and second magnetic pole piece so that the fluid passage bore is in alignment with the upper and lower fluid bores. In this position, fluid will pass through the spray control valve and be sprayed from the can when the spray head is depressed.

In view of the above disclosure, it is the primary object of the invention to provide an aerosol spray can that can only be operated when the can is connected to an a–c utility power source. Because of the a–c power requirement, the average spray paint graffiti tagger will be unable to spray graffiti in most outdoor locations. In addition to the primary object of the invention, it is also an object to provide an aerosol spray can that:

is designed so that if a graffiti tagger attempts to connect a d-c battery to the input of the power-line activator, the blocking capacitor will prevent the d-c voltage from energizing the electromagnet, if a tagger attempts to mechanically adjust the slide and twist valve by puncturing a protective valve cover, the puncture will quickly depressurize the can and create an uncontrolled paint flow at the puncture opening, the movement of the permanent magnet piston lubricates the valve, is reliable and maintenance free, is cost effective from both a manufacturers and consumers point of view, and will save countless manhours expended in the removal of graffiti from various structures.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 7 is a schematic diagram of a first design for powering the power-line activator.

FIG. 8 is a schematic diagram showing the basic elements of the utility-power operated aerosol paint can and a second design for powering the power-line activator.

FIG. 9 is a perspective view of a third design for powering the power-line activator that has rigidly attached an a–c to a–c power supply that includes an a–c power cord having a standard a–c male connector that plugs into an a–c power receptacle. The back of the activator has the knobs for setting the potentiometer and for rotating the threaded locking rod.

FIG. 10 is a perspective view of a spray can that has attached a protective housing that includes a valve bore, a magnetic pole cavity and a threaded locking rod cavity.

FIG. 11 is a sectional view taken along lines 11—11 of FIG. 10 showing the positioning of the valve bore, the magnetic pole cavity and the threaded locking rod cavity.

BEST MODE FOR CARRYING OUT THE INVENTION

The best mode for carrying out the utility-power operated aerosol spray can 10 is presented in terms of a preferred embodiment that prevents an aerosol paint spray can from being used unless it is connected to an a–c power receptacle. Thus, its use for spraying graffiti is eliminated or at least significantly curtailed.

Figure 1:
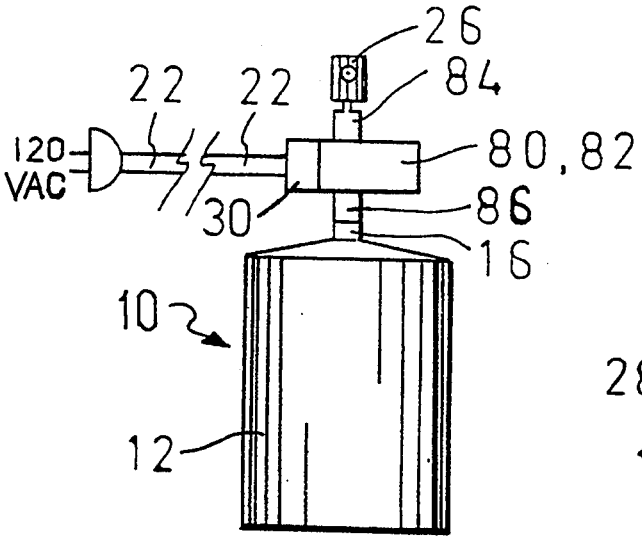
FIG. 1 is an elevational side view showing the basic elements of the utility-power operated aerosol spray can.

The preferred embodiment, as shown in FIGS. 1–19 is comprised of the following major elements: an aerosol spray can 12 modified by the inclusion of a valve attachment port 16, an a–c power cord 22, a standard aerosol-can spray head 26, a power-line activator 30 that includes an electromagnet 36, an electronic control circuit 44, a protective housing 60 and a valve means that preferably consists of a slide and twist valve 80. The major elements are shown mechanically in FIG. 1 and schematically in FIG. 8.

Figure 2:
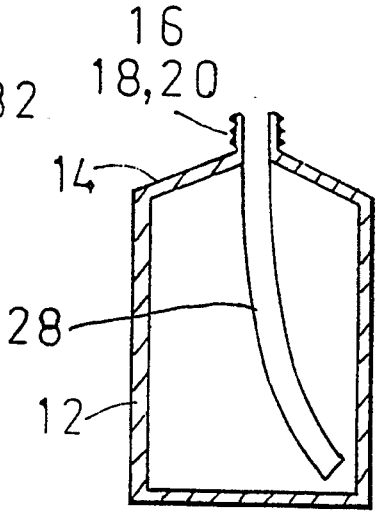
FIG. 2 is a side sectional view of the spray can showing the modified upper section that includes a threaded valve attachment port and the internal fluid hose.

The aerosol spray can 12 is similar to standard spray cans with the exception that the cans upper section 14 as shown in FIG. 2, includes a valve attachment port 16. This port incorporates a threaded section 18 that may consist of preferably male threads 20 or female threads (not shown).

Figure 3:
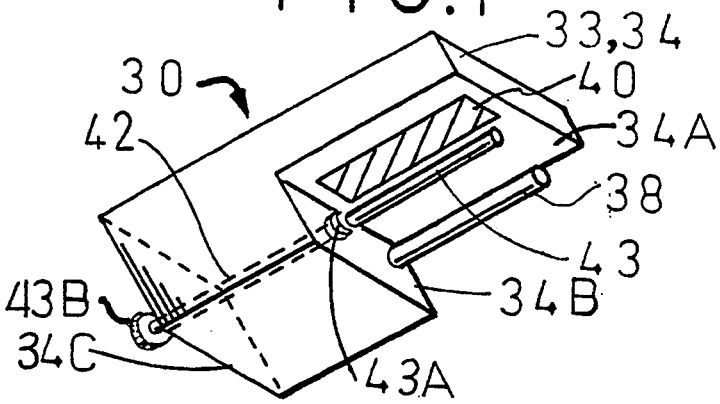
FIG. 3 is a front perspective view of the power-line activator.
Figure 5:
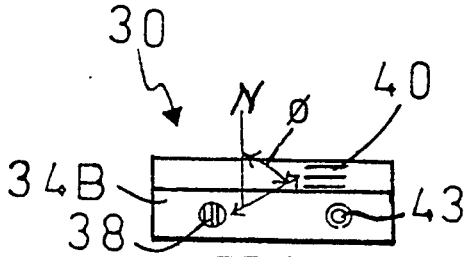
FIG. 5 is a front view of a power-line activator showing the angular relationship $\phi$ of the first magnetic pole rod and the embedded second magnetic pole piece.
Figure 4:
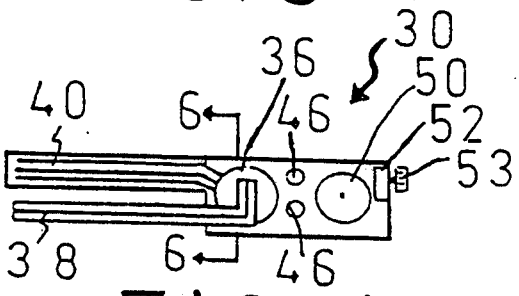
FIG. 4 is a side view of the power-line activator showing the positional relationships of the magnetic poles, rectifier diodes and the blocking capacitor.
Figure 6:
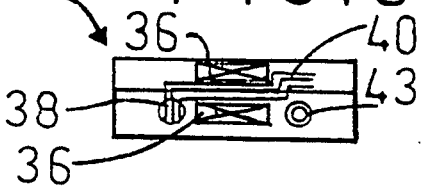
FIG. 6 is a front view of a power-line activator showing the shape of the magnetic pole and the electromagnet coil.

The primary novel feature of the invention is that the spray can is only operable when it is connected by means of an a–c power cord to an a–c utility power receptacle 24 as shown in FIGS. 7, 8 and 9. To accomplish this design, the power-line activator 30 is employed. This activator is comprised of a structure 32 that preferably consists as shown in FIGS. 3–6, of an inverted step 34 consisting further of an upper horizontal section 34A and a stepped vertical section 34B. Within this structure as best shown schematically in FIG. 7, is housed an electromagnet 36 that includes a first magnetic pole rod 38 and a second magnetic pole piece 40 that is embedded into the horizontal section as best shown in FIG. 3. In practice, the pole piece 40 would be visually undetectable. The rod 38 preferably corresponds to a south magnetic pole and the piece 40 to a north magnetic pole. However, the magnetic poles of the rod and piece can be reversed. As also best shown in FIG. 3, the first magnetic pole rod 38 is displaced from the second embedded pole piece 40 by an angle $\phi$ from the vertical where $\phi$ is equal to 45-degrees$\pm$5°.

The structure 32 as shown in FIG. 3, has an attachment rod bore 42 that is spaced apart and in alignment with the first magnetic pole rod 38. Into this bore 42 is inserted a threaded locking rod 43 that includes a threaded section 43A that is rotated by means of a knob 43B that is rigidly attached to the back of the locking rod 43. The knob 43B extends outwardly from the back surface 34C of the structure 32 and is held captive within the structure and attachment rod bore 42 by a holding means. The purpose of the locking rod 43 is described infra.

The electromagnet 36 is operated by an electronic control circuit 44 as shown in FIGS. 7, 8 and 9. This circuit may consist of either a full wave rectifier 46 as shown in FIG. 7 or a half-wave rectifier 48 as shown in FIG. 8 with a full-wave rectifier preferred.

The full-wave rectifier 46 has included on an input leg a blocking capacitor 50 and on the other leg a potentiometer 52. The capacitor prevents an unauthorized user, such as a graffiti tagger, from attaching an external battery to the wires of the power line activator to bypass the a–c operating requirement. The potentiometer 52 adjusts the input voltage to allow the magnetic field to be set at an optimum level to provide the correct longitudinal position for the permanent magnet piston also described infra.

The input to the power-line activator 30 is disclosed in three designs. In the first design as shown in FIG. 7, a two-conductor cable 23 extends directly from the activator 30. The other end of the cable is attached directly to the secondary winding 54B of a step-down transformer that forms a part of an a–c to a–c power supply 54. The primary winding 54A of the transformer is connected directly to a standard a–c male connector that extends from the surface of the a–c to a–c power supply and that plugs into an a–c power receptacle 24.

The second design as shown in FIG. 8, utilizes an activator 30 that is connected to a two-pin male connector 31 via a two-conductor cable 23. The a–c to a–c power supply 54 has its secondary winding 54B connected through a two-conductor cable 23 to a two-pin female connector 33 that mates with the two-pin male connector 31. The transformer's primary winding 54A is connected to an a–c power cord 22 having a standard a–c male connector that plugs into an a–c power receptacle 24.

The third design as shown in FIG. 9 utilizes an a–c to a–c power supply 54 that is an integral element of the activator 30 structure. In this design, an a–c power cord 22 has one end attached directly to the primary winding 54A of said power supply 54 and the other end has a standard a–c male connector that plugs into an a–c power receptacle 24.

Figures 12, 13, 14, 15, 16, 17, 18, 19:
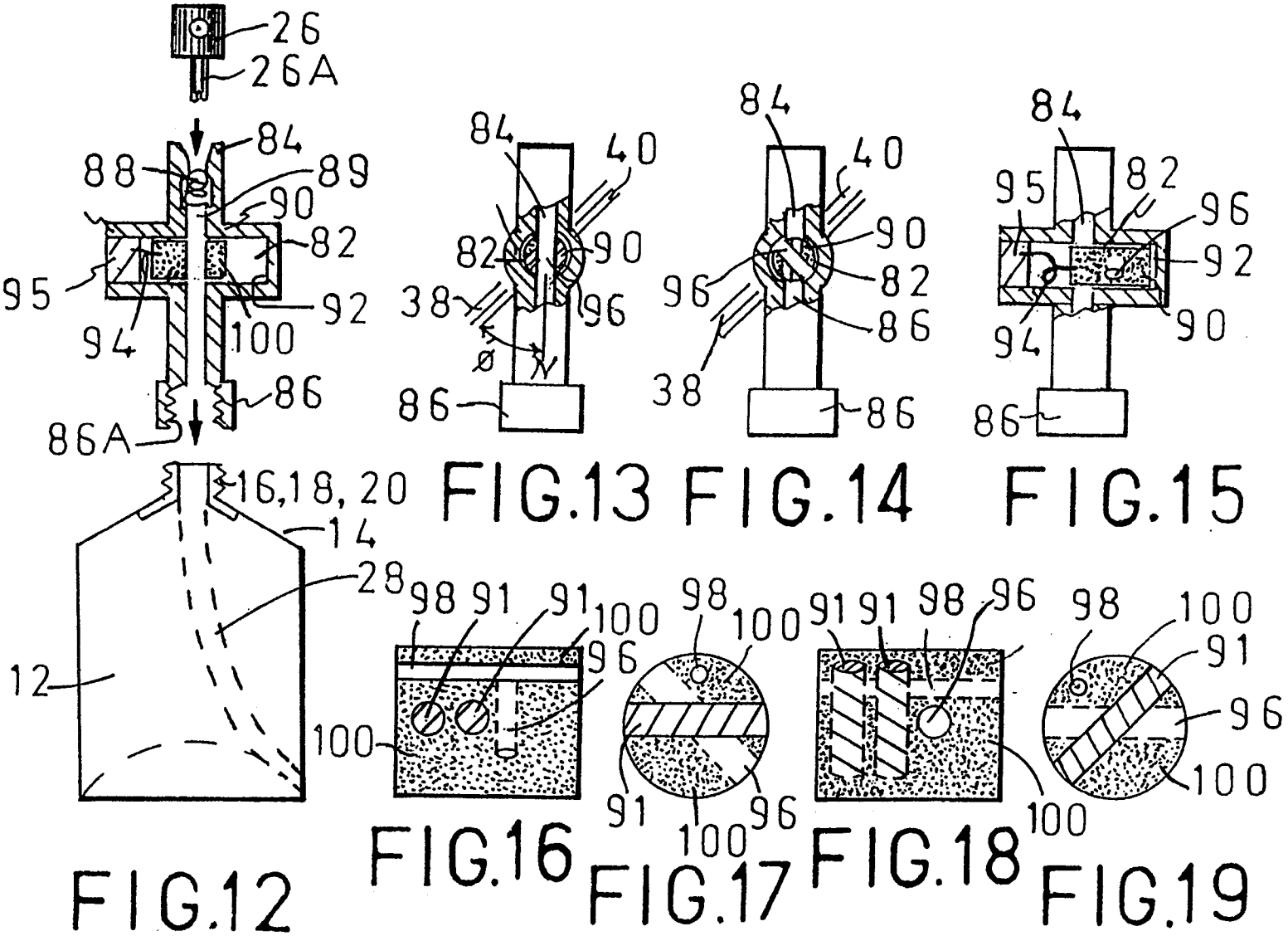
FIG. 12 is a partial, side sectional view showing the relative pre-attachment positions of a spray can, a spray head and a slide and twist valve having a magnetic piston that has overcome the bias of a compression spring and is now positioned to allow fluid to flow.
FIG. 13 is a partial, sectional end view showing the slide and twist valve and piston positioned to allow fluid to flow.
FIG. 14 is a partial, sectional end view showing the slide and twist valve and the piston positioned to prevent fluid flow.
FIG. 15 is a partial side sectional view showing a slide and twist valve having a magnetic piston that is biased by the compression spring and is positioned to prevent fluid flow.
FIG. 16 is a side sectional view of a magnetic piston having a pair of separated permanent magnets, fluid passage bore alongside the separated magnets and a fluid bypass hole on one side of the permanent magnet.
FIG. 17 is an end view of FIG. 16.
FIG. 18 is a side sectional view of a piston that has been radially rotated and having a pair of separated permanent magnets, a fluid passage bore located alongside the separated magnets and a fluid bypass hole at one side of the piston.
FIG. 19 is an end view of FIG. 18.

To the top section of the can 10 is attached a protective housing 60 as shown in FIGS. 10 and 11. The housing, which is preferably constructed of a plastic material, includes an upper section 62, a side section 64 and is sized to be fitted and permanently attached to the upper section 14 of the can 12. The plastic material of the housing 60 is preferably molded to provide an inner surfaces that includes a valve bore 66 that projects through the upper section 62, a valve holding cavity 68, a magnetic pole cavity 70 and a threaded locking rod cavity 72. The valve bore is sized to allow the upper fluid port 86 of the slide and twist valve 80 to protrude outwardly and be attached. Into the port 86, is then inserted the spray head 26 as shown in FIGS. 8, 10 and 12. The pole cavity 70 and locking rod cavity 72 are sized and located to allow the respective first magnetic pole rod 38 and the threaded locking rod 43 to be inserted therein. When the rod 43 is threaded into the threaded cavity 72 as best shown in FIG. 11, the power-line activator 30 is held in place. In FIG. 10, is also shown the magnetic field direction 74 and the electromagnetic field angle $\phi$ with reference to a normal to a horizontal surface (N).

The fluid controlling element of the invention is the slide and twist valve 80 which is shown in FIGS. 11–19. The valve 80 as shown in FIG. 11 is located and held within the valve holding cavity 68 of the protective housing 60. The valve includes a central cavity 82 that interfaces with an upper fluid port 84 and a lower fluid port 86. The upper fluid port 84 extends through the valve bore 66 as shown in FIG. 10. Within the port 84 is attached by an attachment means, a spray control valve 88 that interfaces with the lower hollow tube 26A of the spray head 26. When the spray head 26 is depressed, the spray control valve 88 opens to allow fluid to pass through and be sprayed. The lower fluid port 86 which is in alignment with the upper fluid port 84 has a threaded section 86A that is sized to be threaded into the threaded valve attachment port 16 located on the upper section 14 of the spray can 12. Preferably the valve attachment port 16 includes a threaded section 18 having male threads 20 that are threaded into corresponding female threads on the threaded section 86A. However, the valve attachment port 16 may be designed with female threads (not shown) that are threaded into a corresponding set of male threads (not shown) on the lower fluid port 86.

The interfacing central cavity 82 includes an access port 89 on one end and functions as a cylinder for a permanent magnet piston 90 that travels therein. The end of the magnet 90, opposite the inner wall 92 of the central cavity 82, is attached to one end of a compression spring 94 that has its other end attached by an attachment means, to the inner end of an access plug 95. After the spring's attachment, the access plug 95 is inserted into and attached to the access port 89 to permanently seal the central cavity 82.

The piston preferably has a non-magnetic material such as plastic, surrounding the permanent magnet as shown in FIG. 11. Through this material normal to its longitudinal axis is located a fluid passage bore 96 and a fluid bypass bore 98 paralleling its longitudinal axis. The piston may consist of a single permanent magnet 91 as shown in FIG. 11 or a pair of permanent magnets 91 as shown in FIGS. 16–19. When two magnets are employed, the fluid passage bore 96 is located normal to the piston's longitudinal axis alongside one of the magnets 91 and the fluid bypass hole 98 is located at one side of piston paralleling its longitudinal axis. The hole 98 allows the fluid to pass through to facilitate the movement of the piston 90 when it is moved from one position to another.

When the power-line activator 30 is not inserted into the magnetic pole cavity 70 and threaded locking rod cavity 72, the fluid passage bore 96 of the permanent magnet 90 is displaced from the upper and lower fluid ports 84,86 of the valve 80 both radially and longitudinally by the compression spring 94. When the piston 90 is so displaced as shown in FIGS. 14 and 15, the fluid in the aerosol spray can 12 is prevented from passing through the spray control valve 88 and the spray head 26.

Conversely, when the power-line activator is connected to an a–c utility power receptacle by means of a power cord 22, the electromagnet 36 as shown in FIG. 8 allows the first and second magnetic poles 38,40, which are displaced by an electromagnetic field angle $\phi$ with reference to a normal to a horizontal surface N, to overcome the bias of the compression spring 94. When the bias is overcome, the piston's fluid passage bore 96 is aligned with the upper and lower fluid bores 84,86 to allow fluid to pass through the check valve 88 and be sprayed from the can when the spray head 26 is depressed.

While the invention has been described in complete detail and pictorially shown in the accompanying drawings, it is not to be limited to such details, since many changes and modifications may be in the invention without departing from the spirit and the scope thereof. For example, the primary purpose of the invention is to prevent paint from being sprayed, however, other sprayable fluids are also covered. Hence it is described to cover any and all modifications and forms which may come within the language and scope of the appended claims.

We claim:

1. A utility-power operated aerosol spray can comprising:

a) an aerosol spray can having a valve attachment port attached to its upper section, b) a standard aerosol-can spray head, c) an a–c power cord, and d) a valve means having an upper fluid port within which is attached the spray head and a lower fluid port that is attached by an attachment means to the valve attachment port of said spray can, where said valve is operated by a–c utility power supplied through said power cord, so that when the power is not applied the valve is positioned to prevent the fluid in the can from being sprayed, and conversely, when the power is applied the valve is repositioned to allow the fluid in the can to be sprayed when the spray head is depressed.

2. A utility-power operated aerosol spray can comprising:

a) an aerosol spray can having a valve attachment port attached to its upper section, b) a standard aerosol can spray head, c) an a–c power cord, and d) a slide and twist valve having an upper fluid port within which is attached the spray head and a lower fluid port in alignment with said upper fluid bore and having means for being attached to said valve attachment port, where said valve is connected to an a–c utility power source by means of the a–c power cord, where said valve houses a permanent magnet piston having a fluid passage bore therethrough that is normal to its longitudinal axis and a fluid bypass hole that parallels its longitudinal axis, so that when said valve is not connected to the a–c power source, said piston is positioned by a mechanical means in a first radial and longitudinal position that prevents the fluid in the can from passing through the fluid passage bore, and conversely, when said valve is supplied with a–c power, a piston positioning means places said permanent magnet piston in a second radial and longitudinal position that allows the fluid passage bore to be aligned with the upper and lower fluid ports of said valve so that the fluid in the can is allowed to pass through and be sprayed from the can when the spray head is depressed.

3. The aerosol spray can as specified in claim 2 wherein said valve attachment port includes a set of male threads.

4. The aerosol spray can as specified in claim 3 wherein said permanent magnet piston further comprises a non-magnetic material that surrounds said permanent magnet, with said material having a fluid passage bore therethrough that is normal to its longitudinal axis and a fluid bypass hole therethrough that parallels its longitudinal axis.

5. The aerosol spray can as specified in claim 3 wherein said permanent magnet piston further comprises a non-magnetic material that surrounds a pair of said permanent magnets, with said material having a fluid passage bore located normal to said piston's longitudinal axis alongside one of said magnets and a fluid passage hole located at one side of said piston.

6. The aerosol spray can as specified in claim 3 wherein said a–c utility power is applied via the a–c power cord through a power-line activator comprising:

a) a structure that houses an electromagnet that is operated by an electronics control circuit consisting of a rectifier circuit and a series connected blocking capacitor, b) an a–c to a–c power supply having a secondary winding that lowers the a–c voltage level and that is connected to said power-line activator by an attachment means across one side of said rectifier circuit and said capacitor, and a primary winding that is connected to by means of the a–c power cord to an a–c power receptacle, with said electromagnet having a first magnetic pole rod and a second magnetic pole section that is embedded into said structure and displaced from the first magnetic pole rod by an angle $\phi$, and c) an attachment rod bore spaced apart and in alignment with said magnetic pole rod where into said structure attachment bore is inserted a threaded locking rod that is rotated by means of a knob that is attached to the back of said locking rod and that extends from the back surface of said structure and held captive therein by a holding means.

7. The aerosol spray can as specified in claim 6 wherein said electronics control circuit further comprises a potentiometer connected in series between the secondary winding of said a–c to a–c power supply and the input to said rectifier circuit, where said potentiometer adjusts the input voltage to allow the magnetic field to be set at an optimum level to provide the correct longitudinal position for the permanent magnet piston.

8. The aerosol spray can as specified in claim 7 wherein said means for attaching said a–c to a–c power supply to said power-line activator is provided by a first design comprising a two-conductor cable having one side extending directly from said power-line activator and the other side directly connected to the secondary winding of said a–c to a–c power supply, where the primary winding of said power supply is connected directly to a standard a–c male connector that extends from the surface of said power supply and that plugs into an a–c power receptacle.

9. The aerosol spray can as specified in claim 7 wherein said means for attaching said a–c to a–c power supply to said power-line activator is provided by a second design comprising:

a) a two-pin male connector connected via a two-conductor cable to said power-line activator, and b) a two-pin female connector having one side connected to said two-pin male connector and the other side via a two-conductor cable that is connected to the secondary winding of said a–c to a–c power supply, where the primary winding of said power supply is connected to a standard a–c male connector, via the a–c power cord, that plugs into an a–c power receptacle.

10. The aerosol spray can as specified in claim 7 wherein said means for attaching said a–c to a–c power supply to said power-line activator is provided by a third design comprising an a–c to a–c power supply that is an integral element of said power-line activator structure, where an a–c power cord has one end attached directly to the primary winding of said power supply and the other end has a standard a–c male connector that plugs into an a–c power receptacle.

11. The aerosol spray can as specified in claim 6 wherein said first magnetic pole is polarized with magnetic north and said second magnetic pole section is polarized with magnetic south.

12. The aerosol spray can as specified in claim 6 further comprising a male a–c power connector connected across the primary winding of said a–c to a–c power supply and attached to said power line activator with the a–c power cord, where said connector allows a female receptacle of a standard a–c power cord to be plugged into said connector to power said activator.

13. The aerosol spray can as specified in claim 6 wherein one end of said a–c power cord is permanently attached via an opening in said structure to the primary winding of said a–c to a–c power supply.

14. The aerosol spray can as specified in claim 3 further comprising an outer housing attached to the top section of the aerosol spray can, said protective housing comprising:

(a) an upper section having a valve bore therethrough, and (b) an outer section below said upper section and having a valve holding cavity, a magnetic pole cavity and a threaded locking rod cavity, where said pole and rod cavities are sized and located to allow the respective said first magnetic pole rod and said threaded locking rod to be inserted therein.

15. The aerosol spray can as specified in claim 3 wherein said slide and twist valve further comprises:

a) a spray control valve attached within the upper fluid port by an attachment means, where said spray control valve interfaces with the aerosol-can spray head and that opens when the spray head is depressed and where said upper fluid port extends through the valve bore on said upper section, b) a threaded section located on said lower fluid port where said threads are sized to be threaded into the valve attachment port on the spray can, c) a central cavity that interfaces with said upper fluid port and said lower fluid port and having an access port on one end, and where said mechanical positioning means for positioning said permanent magnet piston comprises a compression spring that has one of its ends attached to said piston and the other end attached by an attachment means, to an access plug, where after attachment of said piston said access plug is inserted into and attached to the access port to seal said central cavity, and d) wherein said piston positioning means that places said piston in a second radial and longitudinal position is provided by said power-line activator when said activator is connected to the a–c utility power, at which time the electromagnet in said activator overcomes the bias of said compression spring and aligns said piston's fluid passage bore with said upper and lower fluid ports of said valve.

16. A utility-power operated aerosol spray can comprising:

a) an aerosol spray can having a threaded valve attachment port attached to its upper section, b) a standard aerosol-can spray head having a lower hollow tube, c) a power line activator comprising:

(1) a structure having an inverted step consisting of an upper horizontal section and a stepped vertical section, (2) an electromagnet that is operated by an electronic circuit consisting of a rectifier circuit that includes on one of its input legs a blocking capacitor, where the input to the rectifier is connected to a secondary winding of an a–c to a–c power supply that steps down the a–c utility power, and where a primary winding of said a–c to a–c power supply is connected by means of an a–c power cord to an a–c utility power receptacle, with said electromagnet having a first magnetic pole rod, and a second magnetic pole section that is embedded into the horizontal section of said structure and displaced from the first magnetic pole rod by an electro-magnetic field angle $\phi$ with reference to a normal to a horizontal surface (N), and (3) an attachment rod spaced apart and in alignment with said first magnetic pole rod where said attachment rod is inserted into a threaded locking rod bore and where the threaded locking rod is rotated by means of a knob that is rigidly attached to the back of said locking rod and that extends outwardly from the back surface of said structure and held captive therein by a holding means, d) a protective housing sized to be permanently attached to upper section of the aerosol spray can, said housing having an inner surface that includes a valve bore, a valve holding cavity, a magnetic pole cavity and a threaded locking rod cavity, where said pole and locking rod cavities are sized and located to allow said respective first magnetic pole rod and said threaded locking rod to be inserted and held therein, e) a slide and twist valve located within said valve holding cavity and comprising:

(1) an upper fluid port that extends through the valve bore on said protective housing and into which is attached by an attachment means, a spray control valve that interfaces with the lower hollow tube of the spray head and that opens when the spray head is depressed, (2) a lower fluid port in alignment with said upper fluid port, with said lower fluid port having a threaded section that is sized to be threaded into the threaded valve attachment port located on the spray can, (3) a central cavity that interfaces with said upper fluid port and said lower fluid port, having an access port on one end and that functions as a cylinder for a permanent magnet piston, where the end of said piston opposite the inner wall of said central cavity is attached to one end of a compression spring that has its other end attached by an attachment means to an access plug, where after attachment of said piston, said access plug is inserted into and attached to the access port to seal said central cavity, with said piston further having therethrough, normal to its longitudinal axis, a fluid passage bore, and also having a fluid bypass hole parallel to its longitudinal axis, where when said power-line activator is not inserted into said magnetic pole cavity and said threaded locking rod cavity, the fluid passage bore is displaced from the upper and lower fluid ports both radially and longitudinally by said compression spring to prevent the fluid in said aerosol spray can from passing through said spray control valve and said spray head, conversely, when said magnetic power-line activator is connected to an a–c utility power receptacle and inserted into the respective magnetic pole cavity and said threaded locking rod cavity, the electromagnet in said activator overcomes the bias of said compression spring and aligns said piston's passage bore with said upper and lower fluid ports to allow fluid to pass through said spray control valve and be sprayed from the can when the spray head is depressed.

17. The aerosol spray can as specified in claim 15 wherein said permanent magnet piston further comprises a non-magnetic material that surrounds said permanent magnet, with said material having a fluid passage bore therethrough that is normal to its longitudinal axis and a fluid bypass bore therethrough that is located parallel to its longitudinal axis.

18. The aerosol spray can as specified in claim 15 wherein said permanent magnet piston further comprises a non-magnetic material that surrounds a pair of said permanent magnets, with said material having a fluid passage bore located normal to said piston's longitudinal axis alongside one of said magnets and a fluid passage hole located at one side of said piston.

19. The aerosol spray can as specified in claim 16 wherein said electronics control circuit further comprises a potentiometer connected in series between the secondary winding of said a–c to a–c power supply and the input to said rectifier circuit, where said potentiometer adjusts the input voltage to allow the magnetic field to be set at an optimum level to provide the correct longitudinal position for the permanent magnet piston.

20. The aerosol spray can as specified in claim 16 wherein said first magnetic pole is polarized with magnetic north and said second magnetic pole section is polarized with magnetic south.

* * * * *